US008663884B2

(12) United States Patent
Ohno et al.

(10) Patent No.: US 8,663,884 B2
(45) Date of Patent: Mar. 4, 2014

(54) ORANGE TONER FOR DEVELOPING ELECTROSTATIC CHARGE IMAGES

(75) Inventors: Yohei Ohno, Tokyo (JP); Kaori Soeda, Tokyo (JP); Miyuki Murakami, Kanagawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 178 days.

(21) Appl. No.: 13/038,514

(22) Filed: Mar. 2, 2011

(65) Prior Publication Data

US 2011/0223528 A1 Sep. 15, 2011

(30) Foreign Application Priority Data

Mar. 11, 2010 (JP) ..... 2010-054296

(51) Int. Cl.
*G03G 9/09* (2006.01)

(52) U.S. Cl.
USPC ..... 430/107.1

(58) Field of Classification Search
USPC ..... 430/107.1
See application file for complete search history.

(56) References Cited

U.S. PATENT DOCUMENTS

| | | | | |
|---|---|---|---|---|
| 2009/0081572 | A1* | 3/2009 | Kmiecik-Lawrynowicz et al. | 430/107.1 |
| 2009/0123854 | A1* | 5/2009 | Itami et al. | 430/48 |
| 2010/0279041 | A1* | 11/2010 | Mathew et al. | 428/35.2 |
| 2011/0151362 | A1* | 6/2011 | Yasukawa et al. | 430/42.1 |

FOREIGN PATENT DOCUMENTS

| | | |
|---|---|---|
| JP | 2000-181170 | 6/2000 |

* cited by examiner

*Primary Examiner* — Mark F Huff
*Assistant Examiner* — Rachel Zhang
(74) *Attorney, Agent, or Firm* — Lucas & Mercanti, LLP

(57) ABSTRACT

An orange toner for developing electrostatic charge images includes a binder resin; and a colorant including a first color material and a second color material; wherein the first color material has a hue angle of −20° to 80° in a L*a*b* color system, the second color material includes C.I. Solvent Orange 63, and the second color material has a content of 0.05 to 0.2 parts by mass to 100 parts by mass of the binder resin.

9 Claims, 2 Drawing Sheets

ORANGE TONER FOR DEVELOPING ELECTROSTATIC CHARGE IMAGES

This application is based on Japanese Patent Application No. 2010-054296 filed on Mar. 11, 2010 in Japanese Patent Office, the entire content of which is hereby incorporated by reference.

BACKGROUND OF THE INVENTION

The present invention relates to an orange toner for developing electrostatic charge images.

In recent years, with remarkable development of digital image input devices, such as a high performance of digital cameras and high image quality of liquid crystal display, printed matters have been also required to expand color reproduction range. For such requirements, color materials have been sought to have higher color purity and the chemical constitutions of color materials have been improved. However, as compared with liquid crystal displays which have a light source in itself and represents colors by the additive color process, since printed matters represent colors by the subtractive color process, it has been difficult to supplement the gaps.

Generally, in color image forming methods by an electrophotographying system, color reproduction is performed with combinations of three color toners such as a yellow toner, a magenta toner, and a cyan toner. Therefore, there are specific problems that the color reproducibility in the high lightness region of secondary colors becomes poor. Concretely, for example, in the case where orange is reproduced, a toner image by a yellow toner and a toner image by a magenta toner are superimposed. Accordingly, saturation and lightness decrease so that it is difficult to obtain an orange image with high saturation and high lightness.

Then, toner has been proposed so as to expand its color reproduction range and to improve hue by including a fluorescence color material as a colorant (for example, refer to Japanese Unexamined Patent Publication No. 2000-181170, Official report).

SUMMARY OF THE INVENTION

The present invention has been achieved in consideration of the above circumstances, and an object of the invention is to provide an orange toner for developing electrostatic charge images which can form the orange image which, has high lightness while having high saturation.

The above object can be attained by the following orange toner for developing electrostatic charge images, which reflects one aspect of the present invention.

An orange toner for developing electrostatic charge images; includes:

a binder resin; and a colorant including a first color material and a second color material;

wherein the first color material has a hue angle of −20° to 80° in a L*a*b* color system, the second color material includes C.I. Solvent Orange 63, and the second color material has a content of 0.05 to 0.2 parts by mass to 100 parts by mass of the binder resin.

DETAILED DESCRIPTION OF THE PREFERRED EMBODIMENT

Hereafter, the present invention will be explained in detail. However, the embodiments described below are preferable embodiment of the present invention, and the present invention is not limited to these embodiments.

[Orange Toner for Developing Electrostatic Charge Images]

The orange toner of the present invention for developing electrostatic charge images (hereafter, merely referred to as "orange toner") includes at least a colorant and a binder resin, wherein the colorant contains at least a first color material being a principal component and a second color material, the first color material has a hue angle of −20° to 80° according to the L*a*b* color system, the second color material is composed of C.I. Solvent Orange 63, and the content of the second color material is 0.05 to 0.2 parts by mass to 100 parts by mass of the binder resin.

[Colorant]

The colorant included in the orange toner of the present invention contains a first color material having a hue angle of −20° to 80° by an L*a*b* color system as a principal component. It is more desirable that the hue angle relating to the first color material is −20° to 40°.

The abovementioned range of the hue angle relating to the first color material makes it possible to form an orange image with high saturation. On the other hand, in the case where the hue angle relating to the first color material is outside the abovementioned range, since a difference between it and the hue angle relating to the second color material mentioned later becomes large, color muddiness occurs, whereby it becomes difficult to form an orange image with high saturation. From the above-mentioned viewpoint, it is desirable that the difference of the hue angle relating to the first color material and the hue angle relating to the second color material is made 50° or less.

Figure 1A:
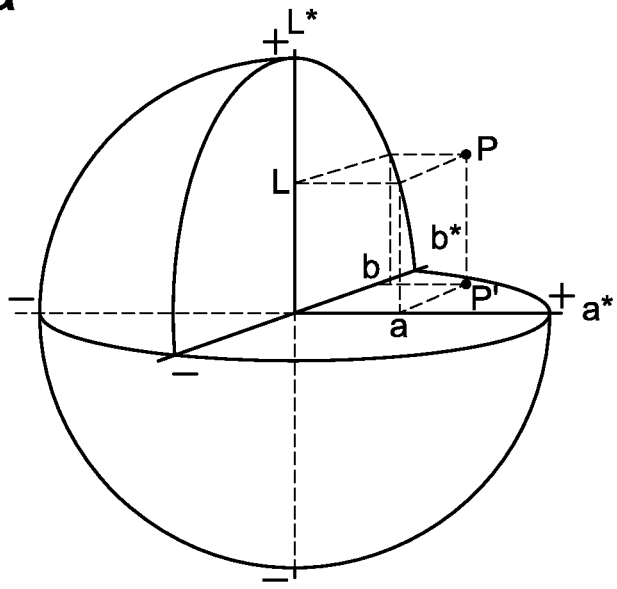
FIG. 1*a* is an L*a*b* coordinate graphics diagram showing a color space by a L*a*b* color system.

Herein, an "L*a*b* color system" is a means employed usefully for representing colors in numerical scales. As shown in FIG. 1, in the L*a*b* coordinate graphics diagram showing a color space by the L*a*b* color system, an L* coordinate axis represents lightness, an a* coordinate axis represents the hue of the red-green direction, and the b* coordinate axis represents the hue of the yellow-blue direction. The lightness means the relative brightness of a color, the hue means the coloration or color tone of red, yellow, green, blue, purple, and the like, and the saturation means the degree of brightness of a color.

Figure 1B:
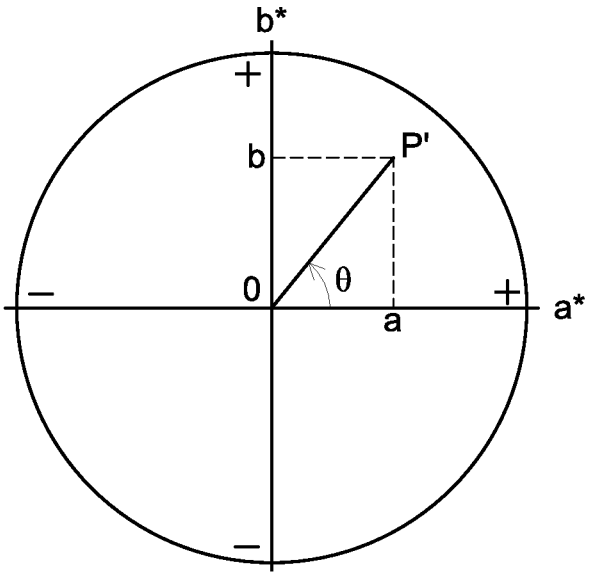
FIG. 1*b* is an a*b* coordinate graphics diagram showing a color space by a L*a*b* color system.

Further, as shown in FIG. 1*b*, for example, in a plane formed by the a* coordinate axis and the b* coordinate axis, a "hue angle" represents an angle θ formed by a line segment OP' between an original point O and a coordinate point P' (a, b) and the a* coordinate axis and concretely, the hue angle is computed by the following formula (H).

$$\text{Hue angle}=\tan^{-1}(b^*/a^*) \qquad \text{Formula (H)}$$

In the abovementioned formula (H), a* and b* represent the values of a and b respectively in the coordinate point (a, b).

Concretely, L*, a*, and b* are measured with a spectrophotometer "Gretag Macbeth Spectrolino" (manufactured by Gretag Macbeth) on the following conditions.

Light source: D65 light source

Reflective measurement aperture: 4 mm (diameter)

Measurement wavelength region: 380 to 730 nm with 10 nm interval

View angle: 2°

Remarks: an exclusive white tile is used for the standard adjustment.

The content of the first color material is preferably 2 to 12 parts by weight to 100 parts by weight of the binder resin, and more preferably 3 to 10 parts by weight. When the content of the first color material is too little, there is fear that the obtained orange toner may have insufficient coloring power. On the other hand, when the content of the first color material is too much, there is fear that electrostatic property may be influenced.

The first color material is preferably a nonfluorescent color material, and specific examples of the first color material include C.I. Pigment Violet 19 (−18.9), C.I. Pigment Red 168 (30.5), C.I. Pigment Orange 5 (40.0), C.I. Pigment Orange 43 (42.0), C.I. Pigment Orange 38 (33.0), C.I. Pigment Orange 36 (51.0), C.I. Pigment Orange 13 (48.0), and the like. Herein the numeral value in brackets represents a hue angle relating to the color material.

Further, a peak wavelength in the absorption spectrum of the first color material is preferably in a range of 450 to 520 nm which is generally deemed as an orange system color.

The colorant contained in the orange toner of the present invention includes the second color material composed of C.I. Solvent Orange 63 being a fluorescent dye in addition to the first color material.

The content of the second color material is made to 0.05 to 0.2 parts by weight to 100 parts by weight of the binder resin, and more preferably 0.06 to 0.1 parts by weight. The content of the second color material in the above range makes it possible to form an orange image with high lightness. When the content of the second color material is too much, concentration quenching takes place so that a sufficient amount of fluorescent emission cannot be obtained. As a result, it is difficult to form an orange image with high lightness. On the other hand, when the content of the second color material is too little, a sufficient amount of fluorescent emission cannot be obtained so that it is difficult to form an orange image with high lightness.

In the colorant contained in the orange toner of the present invention, the contained weight ratio of the first color material and the second color material (the second color material/first color material) is preferably 0.0125 to 0.025, and more preferably 0.0125 to 0.014. When the contained weight ratio (the second color material/first color material) is too small, since the influence of fluorescent emission is strong, there is fear that the obtained color toner may change. On the other hand, when the contained weight ratio (the second color material/first color material) is too large, a sufficient amount of fluorescent emission cannot be obtained so that it is difficult to form an orange image with high lightness.

[Binder Resin]

For example, in the case where orange toner is produced by a crushing method, dissolution suspension method, etc., as a binder resin to be contained in the orange toner of the present invention, employed are various kinds of well-known resins, such as vinyl resins, i.e., a styrene resin, a (meth)acrylic resin, a styrene (meth)acrylic system copolymer resin, and an olefin resin, a polyester resin, a polyimide resin, a carbonate resin, polyether, a polyvinyl acetate resin, a polysulfone, an epoxy resin, a polyurethane resin, an urea resin, and the like. These resins may be employed solely or in a combination of two kinds or more.

Further, for example, in the case where orange toner is produced by a suspension polymerization method, an emulsion polymerization aggregation method, a mini emulsion polymerization aggregation method, examples of a polymerizable monomer to obtain a binder resin include, vinyl monomers, for examples, styrene or styrene derivatives, such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-tert-butyl styrene, p-n-hexylstyrene, p-n-octylstyrene, p-n-nonylstyrene, p-n-decylstyrene, and p-n-dodecylstyrene; methacrylic-acid ester derivatives, such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate; acrylic acid ester derivatives, such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, and phenyl acrylate; olefins, such as ethylene, propylene, and isobutylene; vinyl halides, such as vinyl chloride, vinylidene chloride, vinyl bromide, vinyl fluoride, and vinylidene fluoride; vinyl esters, such as vinyl propionate, vinyl acetate, and vinyl benzoate; Vinyl ethers, such as vinylmethyl ether and vinylethyl ether; vinyl ketones, such as vinyl methyl ketone, vinyl ethyl ketone, and vinyl hexyl ketone; N-vinyl compounds, such as N-vinylcarbazole, N-vinylindole, and N-vinyl pyrrolidone; Vinyl compounds, such as vinylnaphthalene and vinylpyridine; acrylic acid or methacrylic acid derivatives, such as acrylonitrile, methacrylonitrile, and acrylamide. These vinyl monomers can be used singly or in a combination of two kinds or more.

Further, as the polymerizable monomer for obtaining a binder resin, it is desirable to use the above-mentioned polymerizable monomer in combination with compositions having an ionic dissociable group. Polymerizable monomers having such an ionic dissociable group have substituents, such as a carboxyl group, a sulfonic acid group, and a phosphate group, as a structure group. Specific examples of them include acrylic acid, methacrylic acid, maleic acid, itaconic acid, cinnamic acid, fumaric acid, monoalkyl ester maleate, monoalkyl ester itaconate, styrene sulfonate, allyl sulfosuccinate, 2-acrylamido-2-methyl propane sulfonate, acid phosphooxyethyl methacrylate, 3-chloro-2-acid phosphooxypropyl methacrylate, and the like. Further, examples of as such a polymerizable monomer include polyfunctional vinyls, such as t divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentylglycol dimethacrylate, and neopentylglycol diacrylate, and with these polyfunctional vinyls, binder resins having a crosslinking structure may be obtained.

The orange toner of the present invention may contain internal additive agents, such as a charge controlling agent and a releasing agent, if needed.

[Charge Controlling Agent]

As a charge controlling agent, if substances can provide positive or negative charge by frictional electrification and is colorless, well-known various positive charge controlling agents and negative charge controlling agents may be employed without being limited to.

The content ratio of the charge controlling agent is preferably 0.01 to 30 parts by mass to 100 parts by mass of the binder resin, and more preferably 0.1 to 10 parts by mass.

[Release Agent]

As release agents, well-known various waxes may be employed. Specific examples of waxes include polyolefin waxes such as polyethylene wax and a polypropylene wax; branched-chain hydrocarbon waxes such as microcrystalline wax; long-chain hydrocarbon system waxes such as paraffin wax and sasol wax; dialkyl ketone system waxes such as distearyl ketone; ester type waxes, such as carnauba wax, montan wax, behenic acid behenate, trimethylolpropane tribehenate, pentaerythritol tetrabehenate, pentaerythritol diacetate dibehenate, glycerol tribehenate, 1,18-octadecanediol distearate, trimellitic acid tristearyl, distearyl maleate; and amide system waxes, such as ethylenediamine behenyl amide, trimellitic acid tristearyl amide, and the like.

The content of the release agent is preferably 0.1 to 30 parts by weight to 100 parts by weight of the binder resin, and more preferably 1 to 10 parts by weight.

[Production Method of Orange Toner]

Examples of the production method of orange toner of the present invention include, without being specifically limited, a pulverization method, a dissolution suspension method, a suspension polymerization method, an emulsion polymerization aggregation method, a mini emulsion polymerization aggregation method, the other well-known methods, and the like. However, it is desirable to employ an emulsion polymerization aggregation method. According to the emulsion polymerization aggregation method, from viewpoints of a production cost and production stability, the particle size of orange toner particles can be easily made smaller.

Here, according to the emulsion polymerization aggregation method, toner particles are produced in such a way that the dispersion liquid of fine particles of a binder resin (hereafter, merely referred to as "binder resin fine particles") produced by the emulsion polymerization method and the dispersion liquid of fine particles of a colorant (hereafter, merely referred to as "colorant fine particles") are mixed, binder resin fine particles and colorant fine particles are allowed to aggregate until a toner parcel size becomes a desired size, and fusion bonding is conducted among the binder resin fine particles so as to conduct the shape of toner particles.

As a production method of the orange toner of the present invention, one example in the case of employing an emulsion polymerization aggregation method is shown below.

(1-1) a process of preparing a dispersion liquid in which fine particles of the first color material are dispersed in a water based medium (1-2) a process of preparing a dispersion liquid in which particles of the second color material are dispersed in a water based medium (2) a process of preparing a dispersion liquid in which binder resin fine particles, which may contain internal additive agents if needed, are dispersed in a water based medium (3) a process of mixing the dispersion liquid of the fine particles of the first color material, the dispersion liquid of the fine particles of the second color material, and the dispersion liquid of the binder resin fine particles, and causing aggregation, association and fuse bonding among the fine particles of the first color material, the fine particles of the second color material, and binder resin fine particles so as to form orange toner particles (4) a process of filtering the orange toner particles from the dispersion system (water based medium) of the orange toner particles, and removing surface active agents and the like (5) a process of drying the orange toner particles (6) a process of adding external additive agents to the orange toner particles In the case where orange toner is produced by an emulsion polymerization aggregation method, binder resin fine particles obtained by an emulsion polymerization method may have a multilayer structure of two or more layers composed of binder resins different in composition. As binder resin fine particles with such a multilayer structure, for example, binder resin fine particles with a two layer structure may be obtained by a technique in which a dispersion liquid of resin particles is prepared by an emulsion polymerization treatment (first stage polymerization) in accordance with ordinary methods, and then a polymerization initiator and a polymerizable monomer are added to this dispersion liquid so as to subject the system to polymerization treatment (second stage polymerization).

Moreover, according to an emulsion polymerization aggregation method, orange toner particles having a core shell structure may be obtained. Concretely, orange toner particles having a core shell structure can be obtained in the following ways. Firstly, binder resin fine particles for core particles, fine particles of the first color material and fine particles of the second color material are made to cause aggregation, association and fuse bonding so that core particles are produced. Then, binder resin fine particles for a shell layer are added in the dispersion liquid of the core particles, and the binder resin fine particles for a shell layer are made to aggregate and fuse bond on the surfaces of the core particles, whereby a shell layer can be formed so as to cover the surface of each core particle.

Moreover, as a production method of the orange toner of the present invention, one example in the case of employing a pulverization method is shown below.

(I) a process of mixing a binder resin, the first color material, and the second color material, and further internal additive agents if needed with a Henschel mixer (II) a process of kneading the obtained mixture while heating with an extrusion kneading machine (III) a process of conducting rough pulverization treatment for the obtained kneaded material with a hammer mill, and then further conducting pulverization treatment with a turbo mill grinder (IV) a process of conducting fine particle classification treatment for the obtained pulverized material with, for example, an air-current classifier utilizing Coanda effect (V) a process of adding external additive agents to the orange toner particles

[Particle Size of Orange Toner Particles]

The particle size of orange toner particles constituting the orange toner of the present invention is preferably 4 to 10 μm, for example, as a volume-based median size, and more preferably 5 to 9 μm. Due to that fact that the volume-based median size of toner particles resides in the above range, transfer efficiency becomes high, which results in that a halftone image quality is improved and the image quality of thin lines and dots also is improved.

The volume-based median size of orange toner particles is measured and calculated by use of a measurement apparatus in which a data processing computer system (manufactured by Beckman Coulter) is connected to "COULTER Multisizer 3" (manufactured by Beckman Coulter Inc.). Concretely, 0.02 g of orange toner particles are added into 20 mL of a surfactant solution (for the purpose of dispersing orange toner particles, for example, a surfactant solution in which a neutral detergent containing surfactant components is diluted by ten times with purified water) and is made to become familiar with the solution, and thereafter the resultant solution is subjected to an ultrasonic dispersion treatment for one minute so as to prepare a dispersion liquid of orange toner particles. Then, this dispersion liquid of orange toner particles is put by a pipette into a beaker containing "ISOONII" (manufactured by Beckman Coulter Inc.) placed in a sample stand until a display concentration in the measurement device becomes 5% to 10%. Here, this concentration range makes it possible to obtain reproducible measurement values. In this measurement device, the count number of measured particles is set to 25,000 pieces, an aperture size is set to 50 μm, and a measurement range of 1 to 30 μm is divided into 256 divisions. In the measurement, a frequency value is calculated for each division, and the, a 50% particle size from the large side of a volume cumulative fraction is made as a volume-based median size.

[Softening Point Temperature of Orange Toner]

The softening point temperature (Tsp) of the orange toner of the present invention is preferably 70° C. or more and 110° C. or less, and more preferably 70° C. or more and 100° C. or less. Even if the colorant contained in the orange toner of the present invention is received influence by heat, it has stable characteristic with which a spectrum does not change. However, when the softening point temperature (Tsp) is within the abovementioned range, the influence of heat applied to orange toner at the time of fixing can be reduced more. Therefore, since an image formation can be performed without putting burden on the colorant, it is expected that the color reproducibility is exhibited more widely and stably. Moreover, when the softening point temperature (Tsp) of orange toner is within the above-mentioned range, a toner image can be fixed at temperature lower than the conventional technology, and power consumption can be reduced so that the environment-friendly image formation can be realized.

The softening point temperature (Tsp) of orange toner can be controlled by the following methods which may be employed solely or in combination, namely:

(1) adjusting the kind and composition ratio of monomers to form a binder resin, (2) adjusting the molecular weight of a binder resin with the kind and additive amount of chain transfer agents, and (3) adjusting the kind and additive amount of release agents.

As the measurement methods of the softening point temperature (Tsp) of orange toner, the following method may be employed with "Flow tester CFT-500 (manufactured by Shimadzu Corp.)". That is, the sample of orange toner is shaped in the form of a cylinder solid with a height of 10 mm, and is applied with a pressure of $1.96\times10^6$ Pa by a plunger while being heated at a temperature rise rate of 6° C./minute so as to be extruded from a nozzle with a diameter of 1 mm and a length of 1 mm. With this operation, a curve between a descent amount of the plunger of the flow tester and temperature (softening flow curve) is drawn. Then, in the curve, a temperature at which the sample of orange toner initially flowed out is made as a melt starting temperature, and a temperature corresponding to a descent amount of 5 mm is made as a softening temperature.

[External Additive Agent]

In the orange toner of the present invention, orange toner particles may be used on the condition as it is without modification. However, in order to improve flowability, electrostatic property, cleaning property, and the like, external additive agents, such as a fluidizer and a cleaning auxiliary agent may be added into the orange toner particles of the present invention.

Examples of external additive agents include inorganic fine particles, such as inorganic oxide fine particles, such as, silica fine particles, alumina fine particle, and titanium oxide fine particles; inorganic stearic acid compound fine particles, such as aluminum stearate fine particles and zinc stearate fine particles; and inorganic titanic acid compound fine particles, such as such as strontium titanate, zinc titanate, and the like. From a viewpoint of a heat-resistant storage stability and environmental stability, it is desirable that above inorganic fine particles are subjected to a surface treatment with a silane coupling agent, a titanium coupling agent, a higher fatty acid, silicone oil, and the like.

The added amount of such external additive agents is 0.05 to 5 parts by mass to 100 parts by mass of orange toner, and preferably 0.1 to 3 parts by mass. Further, the external additive agents may be used in a combination of various kinds of them.

[Developer]

The orange toner of the present invention may be used as a nonmagnetic one component developer, and also may be used as a two component developer by being mixed with carrier. In the case where the orange toner of the present invention is used as a two component developer, examples of carrier include magnetic particles composed of conventionally well-known materials, such as compounds of ferromagnetic metals, such as iron; alloys of ferromagnetic metals and aluminium or lead; and ferromagnetic metals, ferrite, and magnetite, and specifically, ferrite particles are desirable. Further, examples of such carrier include a coated carrier in which the surfaces of magnetic particles are covered with covering material, such as resin, and a binder type carrier on which magnetic substance fine powders are dispersed in a binder resin. Examples of covering resins constituting the coated carrier include, without specific restriction, olefin system resins, styrene system resins, styrene acrylic system resins, silicone system resins, ester resins, fluorine resins, and the like. Further, examples of resins constituting the resin dispersion type carrier include, without specific restriction, styrene acrylic type resins, polyester resin, fluorine resin, phenol resin, and the like.

The volume-based median size of carrier is preferably 20 to 100 μm, and preferably 20 to 60 μm. The volume-based median size of carrier can be measured typically by a laser diffraction type particle size distribution measuring apparatus "HELOS" (manufactured by Sympatec Corporation) equipped with a wet type dispersion device.

[Image Forming Method]

The orange toner of the present invention can be employed suitably for the image forming method by the general electrophotographying systems, for example, with three color toners of a yellow toner, magenta toner, and a cyan toner. Further, as colorants contained in respective color toners other than the orange toner used for the image forming method employing the orange toner of the present invention, conventionally well-known colorants can be used, and as materials such as binder resins, internal additive agents, and the like, contained in respective color toners, the same materials used for the orange toner of the present invention can be employed.

It is desirable that such a yellow toner contains colorants composed of color materials having a hue angle of 70° to 100°. Specific examples of the colorant contained in the yellow toner include C.I. Solvent Yellow 19, the same 44, the same 77, the same 79, the same 81, the same 82, the same 93, the same 98, the same 103, the same 104, the same 112, the same 162, C.I. Pigment Yellow 14, the same 17, the same 74, the same 93, the same 94, the same 138, the same 155, the same 182, and the same 185. These may be used solely or in combination of two or more. Among them, C.I. Pigment Yellow 74 is preferable. The content of the colorants contained in the yellow toner is preferably 1 to 10 parts by weight to 100 parts by weight of the binder resin, and more preferably 2 to 8 parts by weight.

It is desirable that such a magenta toner contains colorants composed of color materials having a hue angle of −40° to 40°. Specific examples of the colorant contained in the magenta toner include C.I. Solvent Red 1, the same 49, the same 52, the same 58, the same 63, the same 111, the same 122, Pigment Red 5, the same 48:1, the same 53:1, the same 57:1, the same 122, the same 139, the same 144, the same 149, the same 166, the same 177, the same 178, and the same 222. These may be used solely or in combination of two or more. Among them, C.I. Pigment Magenta 122 is preferable. The content of the colorants contained in the magenta toner is preferably 1 to 10 parts by weight to 100 parts by weight of the binder resin, and more preferably 2 to 8 parts by weight.

It is desirable that such a cyan toner contains colorants composed of color materials having a hue angle of 190° to 300°. Specific examples of the colorant contained in the magenta toner include C.I. Pigment Blue 15:3, and the like. The content of the colorants contained in the cyan toner is preferably 1 to 10 parts by weight to 100 parts by weight of the binder resin, and more preferably 2 to 8 parts by weight.

The respective hue angles relating to the orange toner, the yellow toner, the magenta toner, and the cyan toner of the present invention may exist in the order of the magenta toner, the orange toner, the yellow toner, and the cyan toner in the counter clockwise in the L*a*b* color system.

As methods of forming an image by using the orange toner of the present invention and the abovementioned three color toners, concretely, the following methods of (1) and (2) may be employed.

(1) The first method is a so-called direct transfer type image forming method, and employs a toner image forming process in which a latent image is formed on an electrostatic charge image carrying member and developed into a toner image and the toner image is transferred directly onto a transfer material. Accordingly, the first method conducts the toner image forming process for each of four color toners of a yellow toner, orange toner, magenta toner so as to form four color toner images on a transfer material, and fixes the four color toner images on a transfer material so as to form an image on the transfer material.

(2) The second method is a so-called intermediate transfer type image forming method, and employs a toner image forming process in which a latent image is formed on an electrostatic charge image carrying member and developed into a toner image and the toner image is transferred onto an intermediate transfer member. Accordingly, the second method conducts the toner image forming process for each of four color toners of a yellow toner, orange toner, magenta toner so as to form four color toner images on an intermediate transfer member, further transfer four color toner images from the intermediate transfer member onto a transfer material and fixes the four color toner images on the transfer material so as to form an image on the transfer material.

Hereafter, among such image forming methods, the intermediate transfer type image forming method employing four colors toner of a yellow toner, orange toner, magenta toner, and a cyan toner will be explained concretely.

Figure 2:
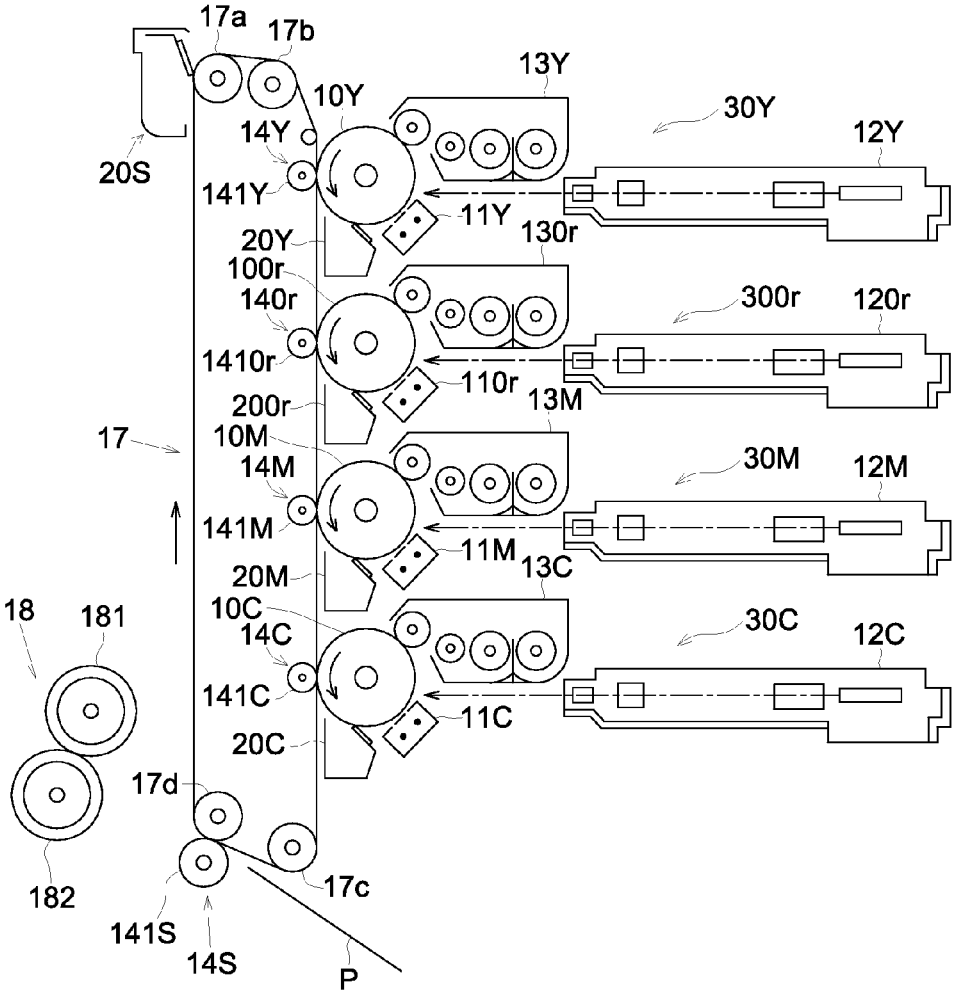
FIG. 2 is an interpretive cross sectional view showing an example of a principal part of the structure of an image forming apparatus used for an image forming method employing the orange toner of the present invention.

FIG. 2 is an interpretive cross sectional view showing an example of the principal part of the structure of an image forming apparatus used for an image forming method employing the orange toner of the present invention. This image forming apparatus includes an endless belt-like intermediate transfer member 17 (hereafter, referred to as an "intermediate transfer belt") arranged on the condition that it is stretched by a group of a plurality of supporting rollers 17*a* to 17*d*. Along the outer peripheral surface of the intermediate transfer belt 17, four toner image forming units 30Y, 30Or, 30M, 30C to form a yellow toner image, orange toner image, magenta toner image and cyan toner image are lined up separately in such a way that the intermediate transfer belt 17 comes in contact with each of photoreceptor drums 10Y, 10Or, 10M, 10C being an electrostatic charge image carrying member in the respective toner image forming units and the intermediate transfer belt 17 moves circularly along the photoreceptor drums 10Y, 10Or, 10M, 10C.

The toner image forming unit 30Y relating to a yellow toner image includes a rotatable photoreceptor drum 10Y, and further include an electrically charging section 11Y, an exposing section 12Y, a developing means 13Y, a primary transfer section 14Y, and a cleaning section 20Y which are arranged along the outer peripheral surface of the photoreceptor drum 10Y in the operation order for the rotation direction of the photoreceptor drum 10Y. The primary transfer section 14Y includes a primary transfer roller 141Y provided so as to form a primary transfer region (primary transfer nip section) by being pressed onto the photoreceptor drum 10Y across the intermediate transfer belt 17 and a transfer current supplying section (not shown) connected to this primary transfer roller 141Y. When a transfer current of predetermined magnitude is supplied to the primary transfer roller 141Y by the transfer current supplying section, a transfer electric field is formed. With the action of the transfer electric field, a yellow toner image formed on the photoreceptor drum 10Y is primarily transferred on the intermediate transfer belt 17.

Other toner image forming units 30Or, and 30M and 30C are structured in the same way as the toner image forming unit 30Y relating to a yellow toner image except that respective developers contain orange toner, magenta toner and cyan toner in place to the yellow toner. In FIG. 2, for convenience, for the same structural components as those in the toner image forming unit 30Y relating to a yellow toner image, the same reference numbers, in which "y" is replaced with "Or", "M", or "C", are provided.

A secondary transfer section 14S is provided at the position of the downstream side from the arrangement region of the toner image forming unit in the moving direction (shown with an arrowed line in FIG. 2.) of the intermediate transfer belt 17.

The secondary transfer section 14S includes a secondary transfer roller 141S provided so as to form a secondary transfer region (secondary transfer nip section) by being pressed across the intermediate transfer belt 17 onto a backup roller 17*d* being one of support rollers to support the intermediate transfer belt 17 and a transfer voltage applying section (not shown) connected to this secondary transfer roller 141S. When a secondary transfer bias voltage with a reverse polarity to the potential of the primarily transferred toner image is applied to the secondary transfer roller 141S by this transfer voltage applying section, a transfer electric field is formed, and with the action of this transfer electric field, the primarily transferred toner image formed on the intermediate transfer belt 17 is transferred to a transfer material P.

In FIG. 2, a numeral 18 represents a fixing device to fix a toner image on the transfer material P conveyed from the secondary transfer region, and the fixing device includes a heating roller 181 having a heat source therein a pressing roller 182 provide such that the pressing roller 182 is brought in contact with the heating roller 181 so as to form a fixing nip section therebetween. Further, a symbol 20S represents an intermediate transfer member cleaning section having a cleaning blade to remove the untransferred toner on the intermediate transfer belt 17, and the intermediate transfer member cleaning section is provided at the position at the downstream side from the secondary transfer region in the moving direction of the intermediate transfer belt 17.

In such an image forming apparatus, first, color toner images formed on the photoreceptor drums 10Y, 10Or, 10M, and 10C of the toner image forming units 30Y, 30Or, 30M and 30C are sequentially transferred and superimposed on the intermediate transfer belt 17, the primarily transferred toner images on the intermediate transfer belt 17 are secondarily transferred onto a transfer material P by the secondary transfer section 14S, and then the secondarily transferred toner images on the transfer material P is fixed by being heated and pressed in a fixing device 18, whereby a toner image is formed on the transfer material P.

As mentioned above, although the embodiment of the image forming method employing the orange toner of the present invention is described, the present invention is not limited to the abovementioned embodiment and various modifications may be added.

[Transfer Material]

As transfer materials used for the above image forming methods, various materials may be employed, and examples of the transfer materials include, without being limited specifically, regular paper sheets from a thin paper sheet to a thick paper sheet, fine quality paper sheets, coated print sheets such as art paper sheets, and coated paper sheets, Japanese paper sheets and postcard sheets available commercially, plastic films for OHP, and cloths.

According to the present invention, the colorant including a first color material having a hue angle of a specific range as a principal component is made to contain an specific amount of a second color material composed of C.I. Solvent Orange 63 being a fluorescent dye. Accordingly, with the first color material, the hue of orange with high saturation is secured, and in addition, since a fluorescent emission can be obtained by the second color material, it becomes possible to obtain an orange image which has high lightness while having high saturation.

EXAMPLE

Although the concrete examples of the present invention will be described hereafter, the present invention is not limited to these examples.

[Preparation Example 1 of a Dispersion Liquid of Colorant Fine Particles]

Into 160 parts by weight of ion exchange water, 11.5 parts by weight of sodium n-dodecyl sulfate was supplied, dissolved and stirred, whereby a surfactant aqueous solution was prepared. Into this surfactant aqueous solution, 21.8 parts by weight of "C.I. Solvent Orange 63" was added gradually, and subjected to dispersion processing with "CLEARMIX W-motion CLM-0.8" (manufactured by M Technique Co., Ltd.), whereby a dispersion liquid of Colorant fine particles [1] was prepared.

[Preparation Examples 2 to 7 of a Dispersion Liquid of Colorant Fine Particles]

A dispersion liquid of each of Colorant fine particles [2] to [7] were prepared in the same way in Preparation example 1 of a dispersion liquid of colorant fine particles except that the color materials indicated in Table 1 were employed in place of "C.I. Solvent Orange 63". The hue angle relating to each of the color materials is shown in Table 1.

TABLE 1

| Color material fine particle No. | Name of color material | Hue angle (°) |
|---|---|---|
| [1] | C.I. Solvent Orange 63 | 11.3 |
| [2] | C.I. Pigment Violet 19 | −18.9 |
| [3] | C.I. Pigment Red 168 | 30.5 |
| [4] | C.I. Pigment Orange 5 | 40.0 |
| [5] | C.I. Pigment Yellow 74 | 90.4 |
| [6] | C.I. Pigment Red 122 | 3.5 |
| [7] | C.I. Pigment Blue 15:3 | 240.0 |

[Production Example 1 of Orange Toner]

(1) Production Example of Resin Particles (a) First Stage Polymerization

Into a reaction container equipped with a stirrer, a temperature sensor, a cooling tube, and a nitrogen introducing unit, 4 parts by weight of polyoxyethylene 2-sodium dodecylether sulfate was supplied together with 3040 parts by weight of ion exchange water, and then a surfactant aqueous solution was prepared. Into this surfactant aqueous solution, a polymerization initiator solution in which 10 parts by weight of potassium persulfate was dissolved in 400 parts by weight of ion exchange water was added as a polymerization initiator, and the temperature of this system was raised to 75° C., thereafter a polymerizable monomer mixed liquid composed of following compounds was dropped into the reaction container over 1 hour.

| | |
|---|---|
| Styrene | 532 parts by weights |
| n-butyl acrylate | 200 parts by weights |
| Methacrylic acid | 68 parts by weights |
| N-octyl mercaptan | 16.4 parts by weights |

After this polymerizable monomer mixed liquor has been dropped, this system was heated and stirred at 75° C. for 2 hours so as to conduct the first stage polymerization, whereby Resin particles [A1] were produced.

(b) Second Stage Polymerization

Into a flask equipped with a stirrer, a polymerizable monomer mixed liquid composed of the following compounds was supplied, and 93.8 parts by weight of paraffin wax "HNP-57" (manufactured by NIPPON SEIRO CO., LTD.) as a releasing agent was added, heated to 90° C., and dissolved in the liquid.

| | |
|---|---|
| Styrene | 101.1 parts by weights |
| n-butyl acrylate | 62.2 parts by weights |
| Methacrylic acid | 12.3 parts by weights |
| N-octyl mercaptan | 1.75 parts by weights |

A surfactant aqueous solution in which 3 parts by weight of polyoxyethylene-2-sodium dodecyl ether sulfate was dissolved in 1560 parts by weight of ion exchange water was prepared, and heated to 98° C. Into this surfactant aqueous solution, 32.8 parts by weight of Resin particle [A1] (solid content conversion) were added, further, a polymerizable monomer mixed liquid containing paraffin wax was added, thereafter, the resultant solution was mixed and dispersed for 8 hours with a mechanical dispersion machine "CLEARMIX" (manufactured by M Technique Co., Ltd.), whereby an emulsified particle dispersion liquid with emulsified particles having a dispersed particle size of 340 nm was prepared. Subsequently, into this emulsified particle dispersion liquid, a polymerization initiator solution in which 6 parts by weight of potassium persulfate was dissolved in 200 parts by weight of ion exchange water was added, and then this system was heated and stirred at 98° C. for 12 hours so as to conduct the second stage polymerization, whereby Resin particle [A2] was produced.

(c) Third Stage Polymerization

Into Resin particle [A2], a polymerization initiator solution in which 5.45 parts by weight of potassium persulfate was dissolved in 220 parts by weight of ion exchange water was added, then this system was placed under a temperature condition of 80° C., and a polymerizable monomer mixed liquid composed of the following compounds was dropped into this system over 1 hour.

| | |
|---|---|
| Styrene | 293.8 parts by weights |
| n-butyl acrylate | 154.1 parts by weights |
| N-octyl mercaptan | 7.08 parts by weights |

After this polymerizable monomer mixed liquid has been dropped, the above system was heated and stirred over 2 hours so as to conduct the third stage polymerization, and was cooled to 28° C., whereby Resin particle [1] was produced.

(d) Production of Shell-Use Resin Particles (Resin Particles Used for a Shell)

Shell-use resin particles [1] were produced with polymerization and processing after the reaction in the same way as in (1) Production example of resin particles except that the polymerizable monomer mixed liquid used in the above (a) First stage polymerization was changed to a polymerizable monomer mixed liquid composed of the following compounds.

| | |
|---|---|
| Styrene | 624 parts by weights |
| 2-ethyl hexyl acrylate | 120 parts by weights |
| Methacrylic acid | 56 parts by weights |
| N-octyl mercaptan | 6.4 parts by weights |

(2) Production Example of Orange Toner Particles

| | |
|---|---|
| Resin particle [1] | 430 parts by weights (solid content conversion) |
| Ion exchange water | 900 parts by weights |
| Color material fine particles [1] | 0.5 parts by weight (solid content conversion) |
| Color material fine particles [2] | 30 parts by weight (solid content conversion) |

The above materials were put into a reaction container and stirred.

The temperature in the reaction container was adjusted to 30° C., and the PH of the solution in the container was adjusted to 8 to 11 by addition of a 5 mol/L sodium hydroxide aqueous solution. Subsequently, an aqueous solution in which 2 parts by weight of magnesium chloride hexahydrate was dissolved in 1000 parts by weight of ion exchange water, was added in the reaction container at 30° C. over 10 minutes while being stirred. After the reaction container has been left untreated for three minutes, temperature rising was started, and the system in the container was heated to 80° C. over 60 minutes so as to allow the system to conduct association. On this condition, the particle size of the associated particles was measured by "Multisizer 3" (manufactured by Coulter corporation), and when the volume-based median size of the associated particles became 6.5 μm, an aqueous solution in which 40.2 parts by weight of sodium chloride was dissolved in 1000 parts by weight of ion exchange water was added so as to stop the association. After the association has been stopped, the solution in the container was heated to 88° C. and subjected to ripening treatment while being heated and stirred over 1 hour so as to continue fusion, whereby Core section [1] was produced.

The average degree of circularity of Core section [1] was measured by "FPIA2100" (manufactured by Sysmex Corporation). As a result, the average degree of circularity was 0.912.

Next, after the temperature of the abovementioned solution was made to 65° C., and 70 parts by weight (solid content conversion) of Shell-use resin particles [1] were added, and further an aqueous solution in which 2 parts by weight of magnesium chloride hexahydrate was dissolved in 1000 parts by weight of ion exchange water was added over 10 minutes, and the resultant solution was heated to 70° C., and stirred over 1 hour. In this way, Shell-use resin particles [1] were made fusion bonding on the surface of Core section [1], and then subjected to ripening treatment at 75° C. for 20 minutes so as to form a shell on the surface of Core section [1].

Thereafter, an aqueous solution in which 40.2 parts by weight of sodium chloride was dissolved in 1000 parts by weight of ion exchange water was added in the above solution so as to stop the formation of shells.

Furthermore, the above solution was cooled to 30° C. in a rate of 8° C./minute, and the produced particles were filtered from the solution, washed repeatedly with ion exchange water with a temperature of 45° C., and then dried with warm air with a temperature of 40° C., whereby Orange toner particles [1] including shells on the surfaces of core sections were produced.

(3) Addition Example of an External Additive Agent

The following external additive agents were added to Orange toner particles [1], and subjected to external additive treatment by use of "Henschel mixer" (manufactured by Mitsui Miike mining company), whereby Orange toner [1] was produced. Orange toner [1] had a volume-based median size of 6.5 μm and a softening point temperature of 107° C. Herein, the volume-based median size and the softening point temperature were measured by the methods mentioned above.

| | |
|---|---|
| Silica subjected to hexamethyl silazane treatment (average first-order particle size: 12 nm) | 0.6 parts by weight |
| Titanium dioxide subjected to n-octyl silane treatment (average first-order particle size: 24 nm) | 0.8 parts by weight |

[Production Examples 2 to 7 of Orange Toner]

Orange toners [2] to [7] were produced in the same way as Orange toner [1] except that the following colorant particles combined as shown in Table 2 were used in place of Colorant fine particles [1] and Colorant fine particles [2] in (2) Production example of orange toner particles in Production example 1 of orange toner. Orange toners [2] to [7] had a volume-based median size of 6.5 μm and a softening point temperature of 107° C. respectively.

TABLE 2

| Toner No. | First color material: Color material fine particle No. | First color material: Content to 100 parts by mass of binder resin (parts by mass) | Second color material: Color material fine particle No. | Second color material: Content to 100 parts by mass of binder resin (parts by mass) |
|---|---|---|---|---|
| [1] | [2] | 6.0 | [1] | 0.1 |
| [2] | [3] | 6.0 | [1] | 0.1 |
| [3] | [4] | 6.0 | [1] | 0.1 |
| [4] | [2] | 6.0 | — | — |
| [5] | [3] | 6.0 | — | — |
| [6] | [4] | 6.0 | — | — |
| [7] | [5] | 6.0 | [1] | 0.1 |

[Production Example 8 of Orange Toner]

(1) Mixing Process

The following materials were mixed by "Henschel mixer" (manufactured by Mitsui Mining Co., Ltd.) with agitating blades having a peripheral speed set at 25 m/second for 5 minutes so as to obtain a mixture.

| | |
|---|---|
| Polyester resin (a condensation product of a bisphenol A-ethyleneoxide adduct, terephthalic acid, and trimellitic acid, weight average molecular weight: 20,000) | 100 parts by weights |
| First color material (C.I. Pigment Violet 19) | 6 parts by weights |
| Second color material (C.I. Solvent Orange 63) | 0.1 parts by weight |
| Releasing agent (pentaerythritol tetrastearate) | 6 parts by weights |
| Charge controlling agent (boron dibenzilate) | 1 part by weight |

(2) Mixing Process

The obtained mixture was kneaded by a biaxial extrusion kneading machine while being heated at 110° C. so as to obtain a kneaded material, and then this kneaded material was cooled.

(3) Pulverizing Process

The obtained kneaded material was pulverized roughly by "Hammer mill" (manufactured by HOSOKAWA MICRON CORP.), and then pulverized finely by "Turbo mill T-400 type" (manufactured by Turbo industrial Corporation).

(4) Classifying Process

The obtained fine powder was subjected to fine powder classification by a wind classifier, whereby Orange toner particles [8] with a volume-based median size of 6.5 μm were obtained.

(5) External Additive Agent Addition Process

The following external additive agents were added to Orange toner particles [8], and subjected to external additive treatment by use of "Henschel mixer" (manufactured by Mitsui Miike mining company), whereby Orange toner [8] was produced. Orange toner [8] had a softening point temperature of 110° C.

| | |
|---|---|
| Silica fine particles subjected to hexamethyl silazane treatment | 0.6 parts by weight |
| Titanium dioxide fine particles subjected to n-octyl silane treatment | 0.8 parts by weight |

The external additive treatment by "Henschel mixer" was conducted on the following conditions.

Peripheral speed of agitating blades: 35 m/second

Processing temperature: 35° C.

Processing time: 15 minutes

[Production Example 1 of Magenta Toner]

Magenta toner [1] was produced in the same way as Orange toner [1] except that 30 parts by weight of color material fine particles [6] (solid content conversion) were used in place of 0.5 parts by weight of color material fine particles [1] and 30 parts by weight of color material fine particles [2] in (2) Production example of orange toner particles in Production example 1 of orange toner.

[Production Example 1 of Yellow Toner]

Yellow toner [1] was produced in the same way as Orange toner [1] except that 30 parts by weight of color material fine particles [5] (solid content conversion) were used in place of 0.5 parts by weight of color material fine particles [1] and 30 parts by weight of color material fine particles [2] in (2) Production example of orange toner particles in Production example 1 of orange toner.

[Production Example 1 of Cyan Toner]

Cyan toner [1] was produced in the same way as Orange toner [1] except that 30 parts by weight of color material fine particles [7] (solid content conversion) were used in place of 0.5 parts by weight of color material fine particles [1] and 30 parts by weight of color material fine particles [2] in (2) Production example of orange toner particles in Production example 1 of orange toner.

[Production Examples 1 to 8 of an Orange Developer, Production Example 1 of a Magenta Developer, Production Example 1 of a Yellow Developer, and Production Example 1 of a Cyan Developer]

Each of Orange toners [1] to [8], Magenta toner [1], Yellow toner [1], and Cyan toner [1] was mixed with ferrite carrier which was covered with a methyl methacrylate resin and cyclohexyl methacrylate resin and had a volume-based average particle size of 50 μm by a V shaped rotary mixer such that a toner concentration of each developer became 6 percent by weight, whereby Orange developers [1] to [8], Magenta developer [1], Yellow developer [1], and Cyan developer [1] were produced.

Examples 1 to 4, Comparative Examples 1 to 5

Into the compound machine "bizhub PRO C6500" (manufactured by Konica Minolta Business Technologies) corresponding to the image forming apparatus shown in FIG. 2, the developer was supplies in accordance with the combinations shown in Table 3, and the following evaluation was conducted. The results are shown in Table 3.

[Evaluation]

An orange solid image with a toner adhesion amount of 4 g/m$^2$ was formed only with orange toner on "POD gross coated paper sheet (128 g/m$^2$)" (manufactured by Oji Paper Co., Ltd.), and L*, a*, and b* of the orange solid image were measured respectively. In Comparative example 5, an orange solid image was formed with a combination of magenta toner and yellow toner.

The value of saturation C* represented by the following formula (I) and lightness L* are shown in Table 3. The acceptable line was made to the condition that both of saturation C* and lightness L* are 75 or more.

$$\text{Saturation}(C^*)=[(a^*)^2+(b^*)^2]^{1/2} \qquad \text{Formula (1)}$$

Herein, L*, a*, and b* are measured with a spectrophotometer "Gretag Macbeth Spectrolino" (manufactured by Gretag Macbeth) on the following conditions.

Light source: D65 light source

Reflective measurement aperture: 4 mm (diameter)

Measurement wavelength region: 380 to 730 nm with 10 nm interval

View angle: 2°

Remarks: an exclusive white tile is used for the standard adjustment.

TABLE 3

| | Orange developer No. | Magenta developer No. | Yellow developer No. | Cyan developer No. | Evaluation result | |
|---|---|---|---|---|---|---|
| | | | | | Saturation C* | lightness L* |
| Example 1 | [1] | — | — | — | 77.7 | 89.1 |
| Example 2 | [2] | — | — | — | 81.6 | 90.8 |
| Example 3 | [3] | — | — | — | 89.1 | 88.5 |
| Example 4 | [8] | — | — | — | 77.7 | 89.1 |
| Comparative example 1 | [4] | — | — | — | 77.2 | 60.7 |
| Comparative example 2 | [5] | — | — | — | 81.2 | 61.1 |
| Comparative example 3 | [6] | — | — | — | 88.9 | 60.9 |
| Comparative example 4 | [7] | — | — | — | 69.9 | 80.5 |
| Comparative example 5 | — | [1] | [1] | — | 70.8 | 60.9 |

From the results of Table 3, it was confirmed to be able to form an orange image having high lightness while having high saturation according to Examples 1 to 4 relating to the present invention.

From the abovementioned explanation, the preferable embodiments of the present invention may be summarized as follows.

The orange toner of the present invention for developing electrostatic charge images is an orange toner for developing electrostatic charge images which includes at least a colorant and a binder resin, wherein the colorant contains at least a first color material being a principal component and a second color material, the first color material has a hue angle of −20° to 80° according to the L*a*b* color system, the second color material is composed of C.I. Solvent Orange 63, and the content of the second color material is 0.05 to 0.2 parts by mass to 100 parts by mass of the binder resin.

In the orange toner of the present invention for developing electrostatic charge images, it is desirable that the content of the first color material constituting the colorant is 2 to 12 parts by mass to 100 parts by mass of the binder resin.

In the orange toner of the present invention for developing electrostatic charge images, it is desirable that the content of the second color material constituting the colorant is 0.06 to 0.1 parts by mass to 100 parts by mass of the binder resin.

In the orange toner of the present invention for developing electrostatic charge images, it is desirable that the first color material constituting the colorant has a hue angle of −20° to 40°.

According to the orange toner of the present invention for developing electrostatic charge images, the colorant includes a first color material having a hue angle of a specific range as a principal component and is made to contain an specific amount of a second color material composed of CI Solvent Orange 63 being a fluorescent dye. Accordingly, with the first color material, the hue of orange with high saturation is secured, and in addition, since a fluorescent emission can be obtained by the second color material, it becomes possible to obtain an orange image which has high lightness while having high saturation.

What is claimed is:

1. An orange toner for developing electrostatic charge images, comprising:

a binder resin; and a colorant including a first color material and a second color material;

wherein the first color material has a hue angle of −20° to 80° in a L*a*b* color system, the second color material includes C.I. Solvent Orange 63, the second color material has a content of 0.05 to 0.2 parts by mass to 100 parts by mass of the binder resin, and a content ratio in parts by mass of the second color material to the first color material (the second color material/the first color material) is 0.0125 to 0.025.

2. The orange toner described in claim 1, wherein a content of the first color material is 2 to 12 parts by mass to 100 parts by mass of the binder resin.

3. The orange toner described in claim 1, wherein a content of the second color material is 0.06 to 0.1 parts by mass to 100 parts by mass of the binder resin.

4. The orange toner described in claim 1, wherein the first color material has a hue angle of −20° to 40°.

5. The orange toner described in claim 1, wherein a difference in hue angle between the first color material, and the second color material is 50° or less.

6. The orange toner described in claim 1, wherein the first color material includes at least one of C.I. Pigment Violet 19, C.I. Pigment Red 168, C.I. Pigment Orange 5, C.I. Pigment Orange 43, C.I. Pigment Orange 38, C.I. Pigment Orange 36, and C.I. Pigment Orange 13.

7. The orange toner described in claim 6, wherein the first color material includes at least one of C.I. Pigment Violet 19, C.I. Pigment Red 168, and C.I. Pigment Orange 5.

8. The orange toner described in claim 1, wherein the first color material has a peak wavelength of 450 to 520 nm in an absorption spectrum.

9. The orange toner described in claim 1, wherein the orange toner has a softening point temperature of 70° C. or more and 110° C. or less.

* * * * *